US010367245B2

(12) United States Patent
Kerkour et al.

(10) Patent No.: US 10,367,245 B2
(45) Date of Patent: Jul. 30, 2019

(54) ASSEMBLY OF REFLECTORS OF ELECTROMAGNETIC ANTENNAE

(71) Applicant: ARIANEGROUP SAS, Paris (FR)

(72) Inventors: Gaelle Kerkour, Maisons Lafitte (FR); Laurent Kalchman, Boulogne Billancourt (FR); Florian Leborgne, Montigny le Bretonneux (FR)

(73) Assignee: ArianeGroup SAS, Paris (FR)

( * ) Notice: Subject to any disclaimer, the term of this patent is extended or adjusted under 35 U.S.C. 154(b) by 12 days.

(21) Appl. No.: 15/742,389

(22) PCT Filed: Jun. 23, 2016

(86) PCT No.: PCT/FR2016/000103
§ 371 (c)(1),
(2) Date: Jan. 5, 2018

(87) PCT Pub. No.: WO2017/013310
PCT Pub. Date: Jan. 26, 2017

(65) Prior Publication Data

US 2018/0198187 A1 Jul. 12, 2018

(30) Foreign Application Priority Data

Jul. 22, 2015 (FR) ..... 15 01553

(51) Int. Cl.
*H01Q 1/38* (2006.01)
*H01Q 1/12* (2006.01)
*H01Q 1/28* (2006.01)

(52) U.S. Cl.
CPC ..... *H01Q 1/1228* (2013.01); *H01Q 1/288* (2013.01)

(58) Field of Classification Search
CPC ..... H01Q 1/1228; H01Q 1/288; H01Q 15/14
See application file for complete search history.

(56) References Cited

U.S. PATENT DOCUMENTS 7,113,145 B1 9/2006 Noble
2015/0180134 A1 6/2015 Boutigny et al.

FOREIGN PATENT DOCUMENTS

EP 0936696 A2 8/1999
EP 2889954 A1 7/2015

OTHER PUBLICATIONS

International Search Report dated Sep. 23, 2016, issued in corresponding International Application No. PCT/FR2016/000103, filed Jun. 23, 2016, 2 pages.
Written Opinion of the International Searching Authority dated Sep. 23, 2016, issued in corresponding International Application No. PCT/FR2016/000103, filed Jun. 23, 2016, 5 pages.
Written Opinion of the International Searching Authority dated Sep. 23, 2016, issued in corresponding International Application No. PCT/FR2016/000103, filed Jun. 23, 2016, 4 pages.
International Preliminary Report on Patentability dated Jan. 23, 2018, issued in corresponding International Application No. PCT/FR2016/000103, filed Jun. 23, 2016, 1 page.

*Primary Examiner* — Graham P Smith
(74) *Attorney, Agent, or Firm* — Christensen O'Connor Johnson Kindness PLLC

(57) ABSTRACT

An assembly comprising at least two reflectors in the form of a thin shell, which are individually attached to a common tubular structure by means of strut lugs. The reflectors, the tubular structure and the strut lugs are made of a fibre-resin composite material. The reflectors can operate in different frequency bands.

8 Claims, 2 Drawing Sheets

ASSEMBLY OF REFLECTORS OF ELECTROMAGNETIC ANTENNAE

The present invention relates to assemblies of reflectors for electromagnetic antennas. Although not exclusively, the invention is particularly suitable for being used in artificial satellites for communication.

Assemblies of reflectors for electromagnetic antennas are already known that comprise two reflectors which are in the form of shells and are rigidly interconnected by means of a common support. In some of these known embodiments, the two reflectors and said common support may even be formed in a single moulded piece.

The use of assemblies of antenna reflectors of this kind is particularly advantageous when said assemblies are deployable on and hinged to the structure of an artificial satellite. Indeed, in this case, the same deployment device can be used for the two reflectors, and this saves weight and costs.

However, in these known assemblies of antenna reflectors, the reflectors are mechanically and thermally coupled to one another by means of said common support such that the thermoelastic deformations of one reflector are transmitted to the other, and all of the thermoelastic deformations of the reflectors may be combined so as to exacerbate their negative effects on the performance of the associated antennas. Consequently, these known assemblies of antenna reflectors have to comprise a common support of increased weight and can only comprise reflectors which have the same technology.

Furthermore, the known assemblies of antenna reflectors are produced according to particular antenna configurations which cannot be adapted to different configurations.

The object of the present invention is to overcome these drawbacks.

For this purpose, according to the invention, the assembly comprising at least two reflectors for electromagnetic antennas, said reflectors being in the form of shells and said shells being supported by a common support, is characterised in that:

- said shells are made of a fibre-resin composite material,
- said common support is a tubular structure consisting of tube portions which are made of fibre-resin composite material and are joined to one another; and
- said shells are individually attached to said tubular structure by means of spacer lugs.

It will be readily understood that:

- given that the shells and the common support are made of fibre-resin composite material, based in particular on carbon fibres and epoxy resin, said assembly may be light, especially since said shells may be thin but still have excellent mechanical properties;
- given that the common support is in the form of a tubular unit, it is readily adaptable to a plurality of different configurations;
- given that spacers, preferably also made of fibre-resin composite material, are interposed between said shells and the common support, thermal and mechanical coupling between said shells by means of the common support is almost completely eliminated; and
- as a result of thermal and mechanical decoupling brought about by the spacer lugs, it is easily possible to produce assemblies in which said reflectors operate in different frequency bands.

For example, one of the reflectors of the assembly may operate in a frequency band below the Ka band, whereas the other reflector operates in the Ka band or in the Q/V band.

In the first case, the shell of the reflector can be perforated, and this further reduces the weight and makes said shell insensitive to acoustic loads.

Preferably, the tube portions of the tubular structures are joined to one another by means of sleeves which are also made of fibre-resin composite material and to which said portions are attached by adhesion.

The spacer lugs can also be made of a fibre-resin composite material and be in the form of an angle bracket, one leg of which is glued to the convex surface of the corresponding shell and the other leg of which is glued to a tube portion of the tubular structure. A spacer lug of this kind makes it possible to keep a gap between the reflector shell and the tubular structure, and therefore to decouple said reflector shell from said tubular structure.

Particularly in the event that the assembly of reflectors is mounted on the body of an artificial satellite so as to be able to assume a folded position, and then a deployed position, it is advantageous for said tubular structure to comprise at least one arm which allows said assembly of reflectors to be hinged to said satellite body.

The figures of the accompanying drawings will show how the invention can be implemented. In these figures, identical reference numerals denote similar elements.

Figure 1:
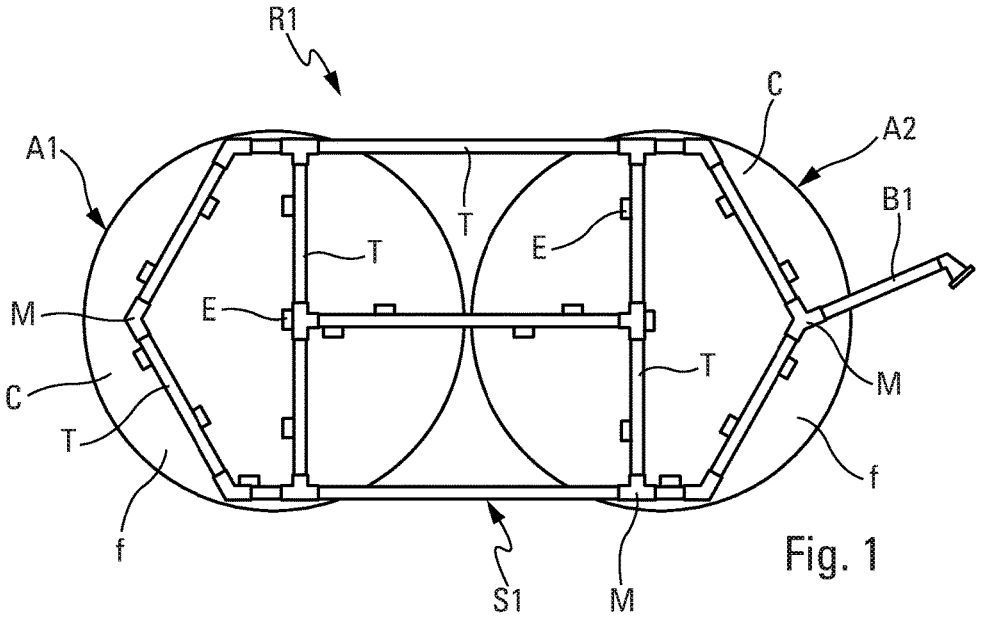
FIG. 1 is a rear view of an embodiment of the assembly of antenna reflectors according to the present invention, showing the common support and the rear convex surface of said reflectors.
Figure 2:
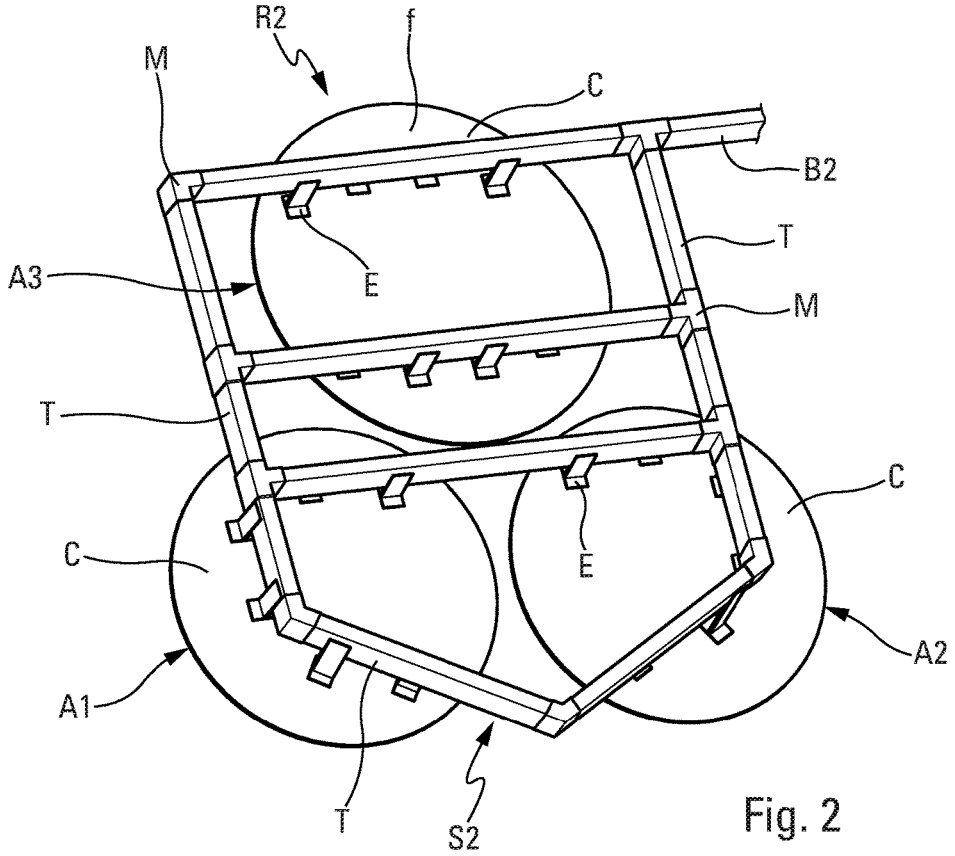
FIG. 2 is likewise a rear view of a variant of the assembly of antenna reflectors according to the present invention.

The embodiments R1 and R2 of assemblies of reflectors for electromagnetic antennas shown in FIGS. 1 and 2, respectively, each comprise a tubular structure S1 or S2 formed by joining tube portions T made of fibre-resin composite material, for example based on carbon fibres and epoxy resin.

Figure 3:
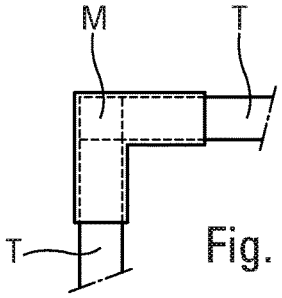
FIGS. 3, 4 and 5 show example joining sleeves for the tube portions of the common supports of the assemblies of reflectors from FIGS. 1 and 2.
Figure 4:
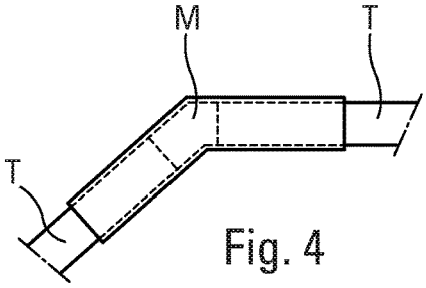
Figure 5:
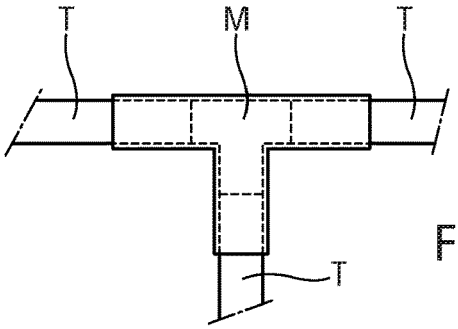

The tube portions T are joined to one another by means of fitting sleeves M which are also made of fibre-resin composite material and in which the ends of the tube portions T are fitted and glued. The fitting sleeves M can also be made of a composite material based on carbon fibres and epoxy resin and can have different shapes. By way of non-limiting example, FIGS. 3, 4 and 5 show fitting sleeves M for joining two tube portions T at a right angle, for joining two tube portions T at an obtuse angle, and for joining three tube portions T, respectively. Of course, types of sleeve M that are different from those shown in FIGS. 4, 5 and 6 can be used.

The tubular structures S1 and S2 are used as a common support for at least two antenna reflectors. In the shown examples, the tubular structure S1 from FIG. 1 supports two reflectors A1 and A2, whereas the tubular structure S2 from FIG. 2 supports three reflectors A1, A2 and A3.

Each of the reflectors A1, A2 and A3 consists of a thin shell C made of fibre-resin composite material (see FIG. 6), preferably a carbon fibre-epoxy resin composite material.

Depending on the frequency band in which the reflector A1, A2, A3 operates, the structure of its thin shell C may be solid or perforated.

Figure 7:
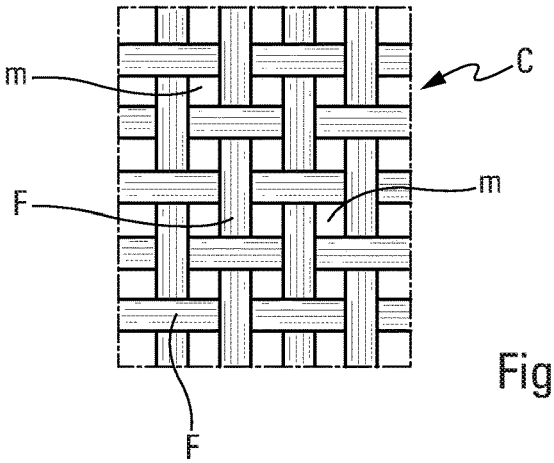
FIG. 7 shows a non-limiting embodiment of the perforated structure of an antenna shell operating in a frequency band below the Ka band.

For example, if one of said reflectors operates in a frequency band below the Ka band, its shell C may be perforated, and this reduces the weight thereof. As shown schematically in FIG. 7, by way of non-limiting example, the perforations in said shell may be formed by meshes m formed in the interlacing of the fibre strands F which make up said shell.

Conversely, if one of the reflectors A1, A2, A3 operates in the Ka or Q/V frequency band, the fibre strands F of the interlacing of fibres that form its shell C do not have any meshes therebetween, and therefore said shell is solid.

Figure 6:
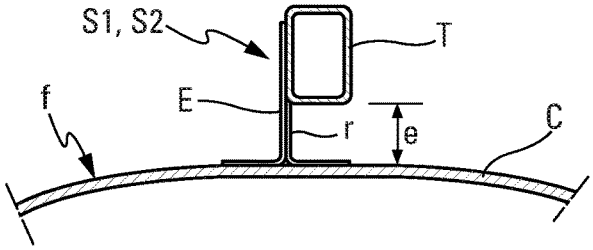
FIG. 6 is a schematic cross section through a spacer lug which connects the rear convex surface of a reflector to a tube portion of the common support.

The shells of each reflector A1, A2, A3 are individually attached to the tubular structures S1 and S2 by means of spacer lugs E. As shown in FIG. 6, the spacer lugs E are in the form of angle bars, one leg of which is glued to the convex surface f of the corresponding shell C and the other leg of which is glued to a tube portion T of the structure S1 or S2. The spacer lugs E are made of a fibre-resin composite material, preferably based on carbon fibres and epoxy resin, and they maintain a gap e between the structure S1, S2 and the shell C.

Optionally, the spacer lugs E can comprise an opposing reinforcing angle bar r which is made of fibre-resin composite material and is glued to said convex surface f of the corresponding shell C.

As shown in FIGS. 1 and 2, the assemblies of reflectors R1 and R2 can comprise an arm B1 or B2 which is part of the tubular structure S1 or S2 and is intended for allowing said assemblies of reflectors to be hinged to the body of an artificial satellite.

The invention claimed is:

1. An assembly comprising:

at least two reflectors for electromagnetic antennas, said reflectors being in the form of shells and said shells being supported by a common support, wherein:

said shells are made of a fibre-resin composite material;

said common support is a tubular structure comprising tube portions which are made of fibre-resin composite material and are joined to one another; and said shells are individually attached to said tubular structure by spacer lugs.

2. The assembly according to claim 1, wherein said antenna reflectors are at least two different types of reflector which operate in different frequency bands.

3. The assembly according to claim 2, wherein one of the types of reflector operates in a frequency band below the Ka band, and wherein the shell of said reflector is perforated.

4. The assembly according to claim 2, wherein one of the types of reflector operates in the Ka or Q/V frequency band, and wherein the shell of said reflector is solid.

5. The assembly according to claim 1, wherein said tube portions of said tubular structure, which portions are made of fibre-resin composite material, are joined at least in part by fitting sleeves which are rigidly connected to said tube portions by adhesion.

6. The assembly according to claim 5, wherein said fitting sleeves are made of a fibre-resin composite material.

7. The assembly according to claim 1, wherein the spacer legs are made of a fibre-resin composite material and are in the form of an angle bracket, one leg of which is glued to the convex surface of the corresponding shell and the other leg of which is glued to said tubular structure while maintaining a gap between said structure and said convex surface.

8. The assembly according to claim 1, wherein said tubular structure comprises at least one arm which allows said assembly of reflectors to be hinged to the body of an artificial satellite.

* * * * *